US008089009B2

(12) United States Patent
Chou et al.

(10) Patent No.: US 8,089,009 B2
(45) Date of Patent: Jan. 3, 2012

(54) ANNULAR MULTI-INSTRUCTION SWITCH

(75) Inventors: Chin-Wen Chou, Taipei Hsien (TW); Tsui-Jung Su, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 577 days.

(21) Appl. No.: 11/979,054

(22) Filed: Oct. 30, 2007

(65) Prior Publication Data

US 2009/0107825 A1 Apr. 30, 2009

(51) Int. Cl.
*H01H 19/00* (2006.01)

(52) U.S. Cl. ..... 200/5 B; 200/517

(58) Field of Classification Search ..... 200/5 R, 200/5 A, 5 B, 17 R, 11 R, 11 C, 517, 564–572, 200/336

See application file for complete search history.

(56) References Cited

U.S. PATENT DOCUMENTS 6,603,086 B2 * 8/2003 Kawaguchi et al. ..... 200/517
6,917,007 B2 * 7/2005 Hirai et al. ..... 200/516
7,091,437 B2 * 8/2006 Yeh et al. ..... 200/571
7,145,087 B1 12/2006 Su et al.
7,378,609 B1 * 5/2008 Fedorjaka ..... 200/516
7,414,205 B1 * 8/2008 Heinrich et al. ..... 200/4

FOREIGN PATENT DOCUMENTS

TW 481027 3/2002
TW I264024 B 10/2006
TW M314411 U 6/2007

* cited by examiner

*Primary Examiner* — Renee Luebke
*Assistant Examiner* — Marina Fishman
(74) *Attorney, Agent, or Firm* — Muncy, Geissler, Olds & Lowe, PLLC

(57) ABSTRACT

The preset invention includes a circuit board wired to connect at least one common terminal and a plurality of signal terminals to form multiple instruction switches and an annular click member. Each of the instruction switches has an elastic contact element built with a return force. The circuit board has a plurality of displacement portions. The annular click member has actuating portions corresponding to and engageable with the displacement portions such that the annular click member is movable up and down relative to the circuit board to form a normal position and an instruction generating position. When the annular click member receives a force and is moved to the instruction generating position, a contact depresses the elastic contact element to store the return force When the force is released from the annular click member it is pushed by the return force of the elastic contact element to the normal position.

8 Claims, 8 Drawing Sheets

ANNULAR MULTI-INSTRUCTION SWITCH

FIELD OF THE INVENTION

The present invention relates to an annular multi-instruction switch and particularly to a switch having a housing space to allow a rotary instruction switch to be coupled with a multi-direction key.

BACKGROUND OF THE INVENTION

Multi-direction key is widely used on various types of information appliances (IAs) nowadays, such as mobile phones, PDAs, computer keyboards and the like. For instance, R.O.C. patent publication No. 481027 and patent No. M314411 disclose a key allowing four-way or eight-way operation.

However, the multi-direction keys mentioned above can execute only one instruction in one direction. Hence maximum number of instructions executable is limited to nine, including an eight-way key and a central key. They cannot meet the present software requirements that demand a greater number of instructions. In view of this concern, the Applicant proposed in U.S. Pat. No. 7,145,087 and R.O.C. patent No. I264024 a multi-instruction switch which has a control disk, an anchor member and a depressing element. The control disk can drives a first conductive element to rotate relative to the anchor member. The anchor member includes a terminal connector containing a common terminal, a first terminal, at least one second terminal and a third terminal. By rotating the control disk a first conductive element is connected to the common terminal in normal conditions, and connected alternately to a contact zone and a non-contact zone of the first terminal and the second terminal to generate multiple sets of instructions. Through the depressing element the common terminal and the third terminal are connected to output multiple sets of instructions. Hence one switch can execute multiple actions. The switch also can be made smaller in a simpler structure.

However, many users still are used to the conventional four-way or eight-way key. But due to the conventional multi-direction key has a central key it cannot be coupled with the rotary multi-instruction switch mentioned above. As a result, users still cannot use the multi-direction key and the rotary instruction switch together at the same time to meet operation requirement.

SUMMARY OF THE INVENTION

The primary object of the present invention is to solve the aforesaid disadvantages. The invention provides an annular multi-instruction switch which includes a circuit board and an annular click member. The circuit board is wired to connect at least one common terminal and a plurality of signal terminals to form a plurality of instruction switches. Each of the instruction switches has an elastic contact element to provide a return force. The circuit board further has a plurality of displacement portions. The annular click member has actuating portions corresponding to and coupling with the displacement portions to enable the annular click member to be moved up and down relative to the circuit board at a normal position and an instruction generating position. Moreover, the annular click member has an installation opening in the center to form a housing space with the circuit board. The annular click member further has contacts corresponding to the elastic contact elements. Thus when the annular receives a force and moved to the instruction generating position the contact presses the elastic contact element to store the return force, and the common terminal and the signal terminal are connected to generate and output an instruction signal. When the force on the annular click member is released, the return force of the elastic contact element pushes the annular click member to bounce back to the normal position.

Another object of the invention is to couple a rotary instruction switch and a multi-direction key through the central housing space on the annular multi-direction switch.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
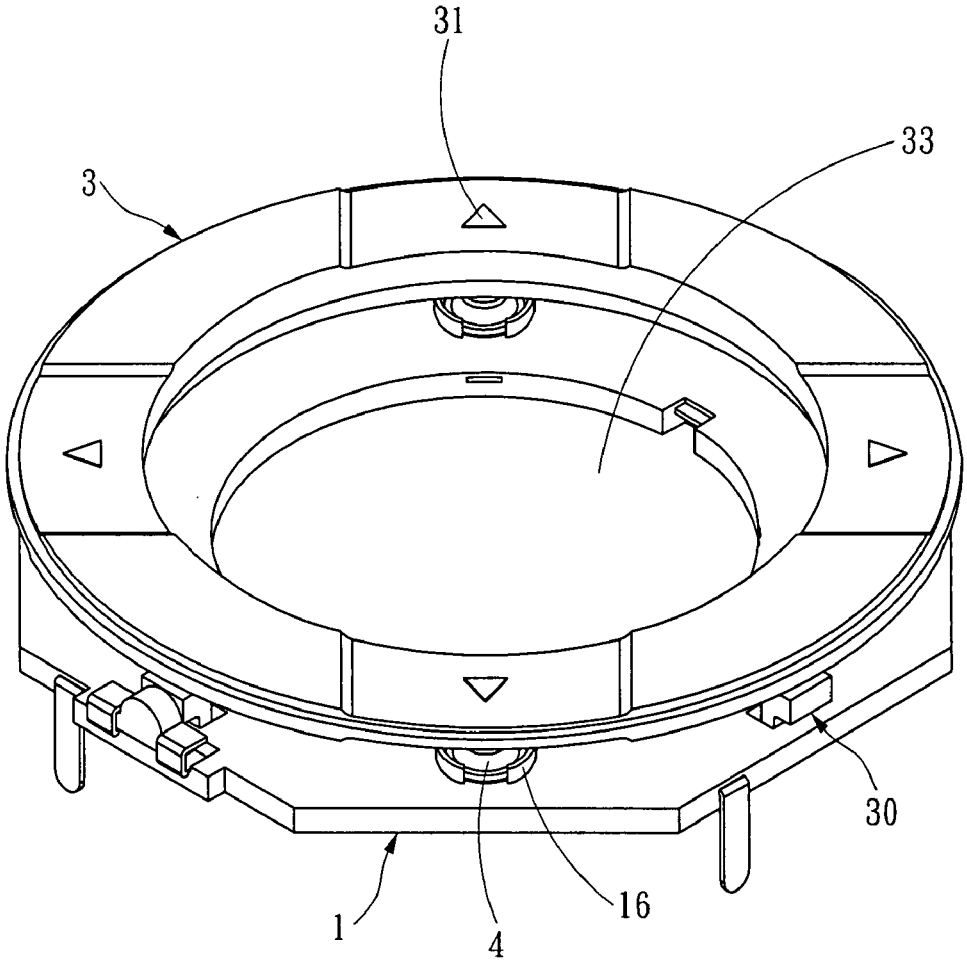
FIG. 1 is a perspective view of the invention.
Figure 2A:
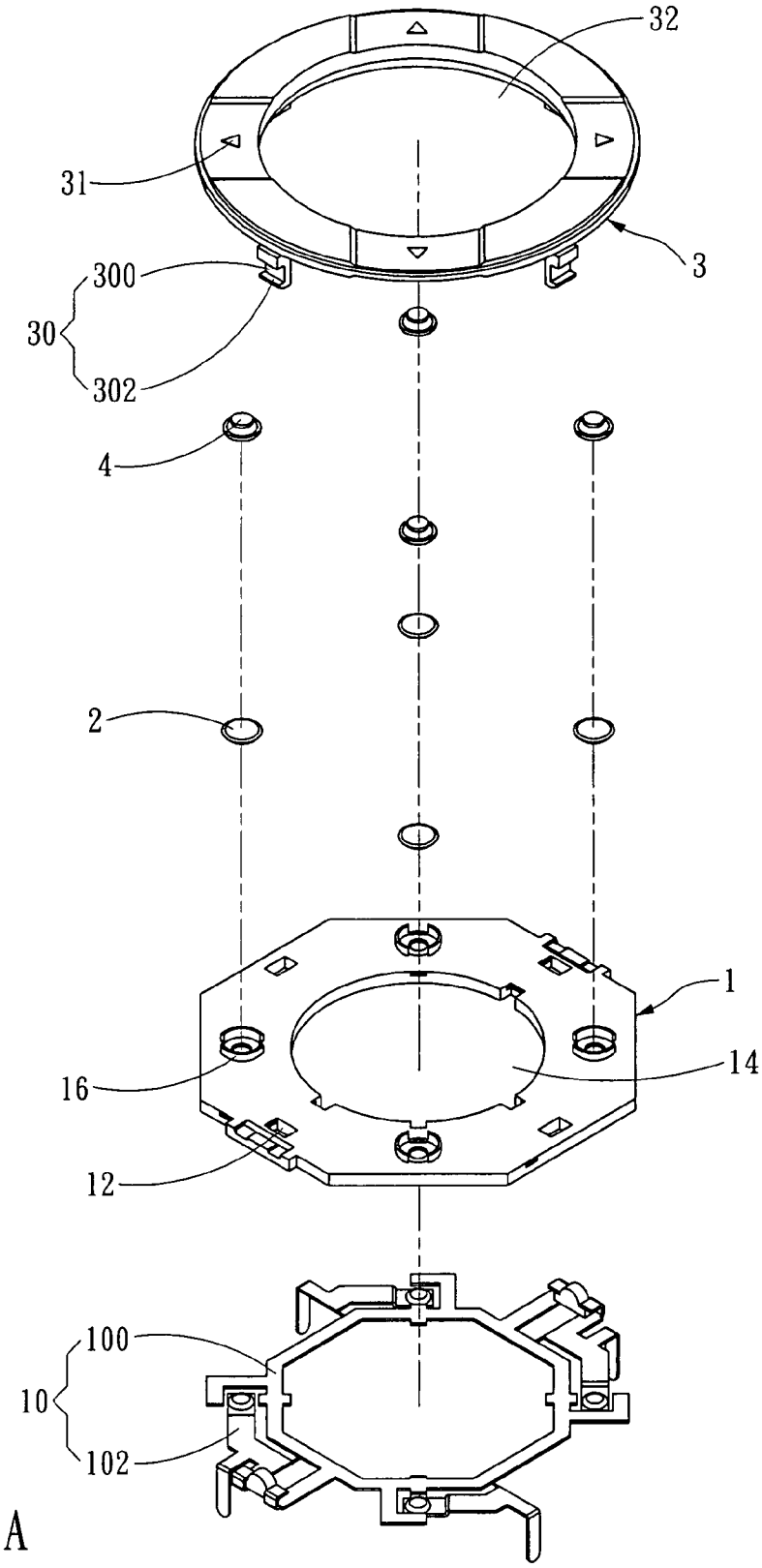
FIG. 2A is an exploded view of the invention.
Figure 2B:
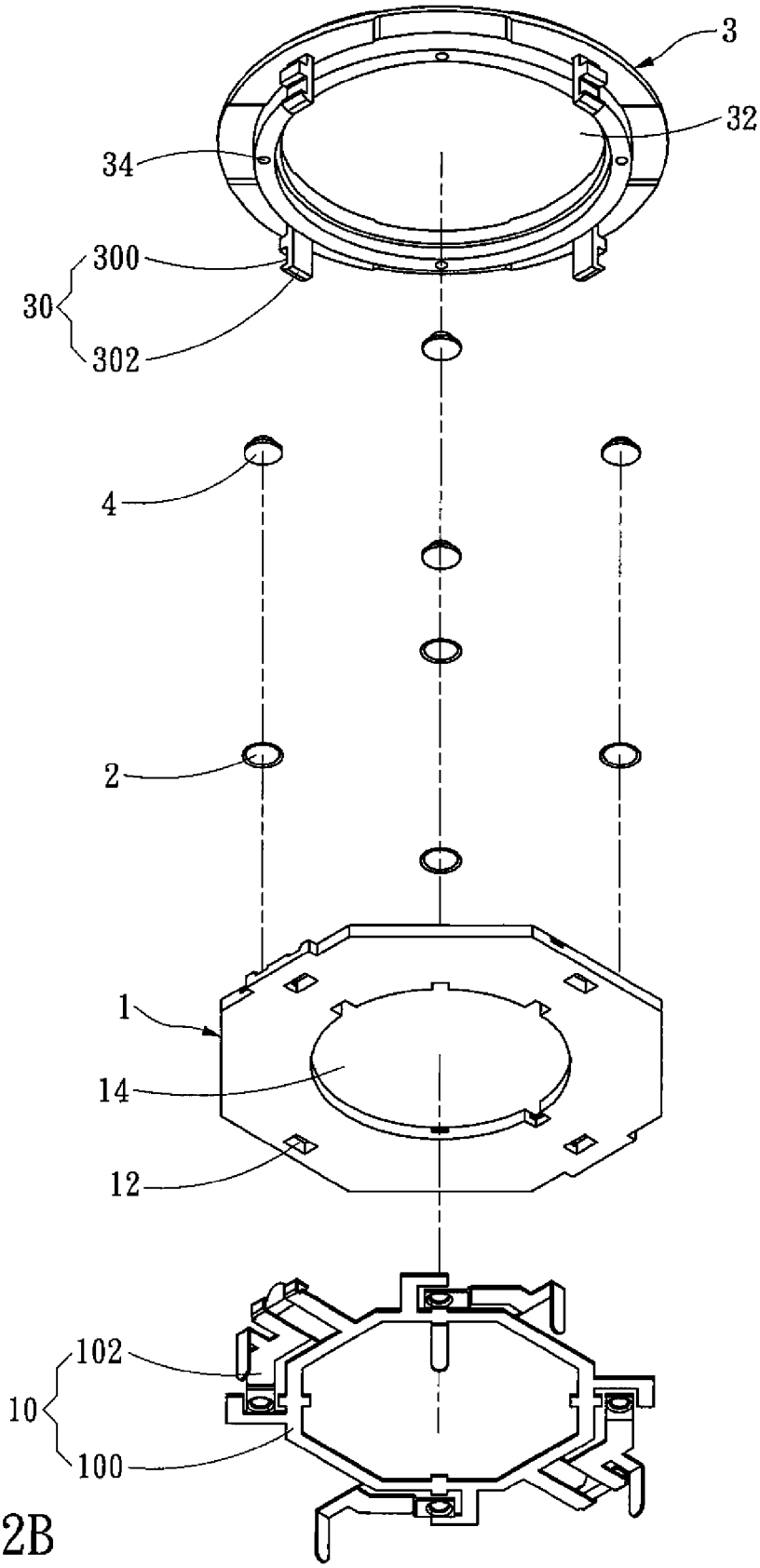
FIG. 2B is another exploded view of the invention.

Please refer to FIGS. 1, 2A and 2B, the annular multi-instruction switch according the invention includes:

a circuit board 1 which is wired to connect at least one common terminal 100 and a plurality of signal terminals 102 to form multiple instruction switches 10. Each of the instruction switches 10 has an elastic contact element 2 built with a return force. The circuit board 1 further has a plurality of displacement portions 12. In this embodiment the circuit board 1 also has a jutting detent wall 16 surrounding the elastic contact element 2 to prevent erroneous conductive contact. The displacement portion 12 is an aperture; and an annular click member 3 which has an actuating portion 30 corresponding to each displacement portion 12 such that the annular click member 3 can generate an up and down movement (discussed later) relative to the circuit board 1 at a normal position and an instruction generating position. The annular click member 3 also has instruction marks 31 on the surface where the instruction switches 10 are located and an installation opening 32 in the center that in cooperating with another installation 14 of the same shape formed on the circuit board 1 to form a housing space 33. The elastic contact element 2 and the annular click member 3 are interposed by an elastic element 4 to aid support and the return force. The elastic element 4 also prevents contacts 34 formed on the annular member 3 corresponding to the elastic contact elements 2 from directly pressing the elastic contact elements 2. By forming the elastic element 4 in a desired specification the elevation of the annular click member 3 can be determined. The contacts 34 can be formed integrally in a bulged fashion on the annular click member 3.

Figure 3:
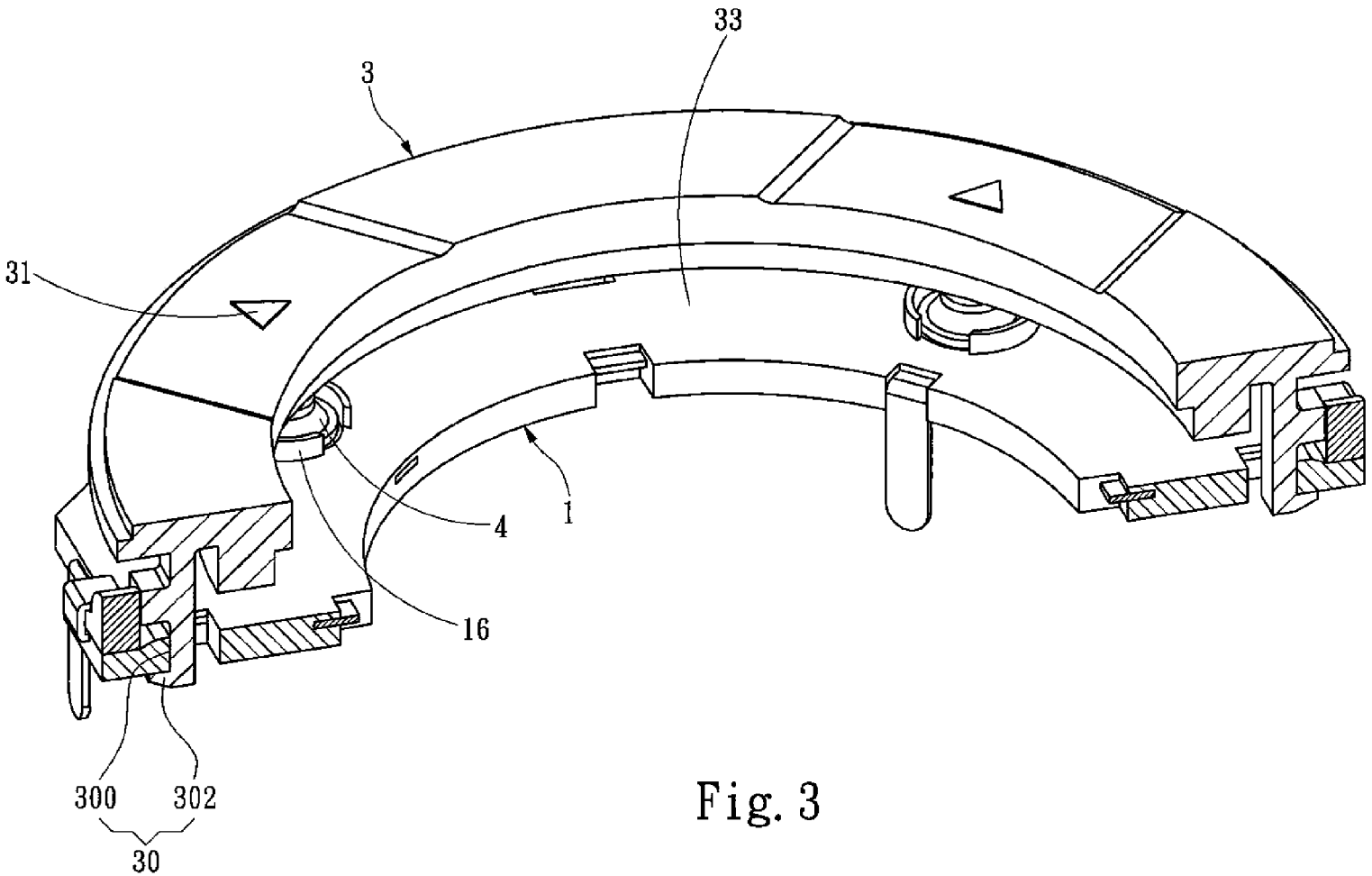
FIG. 3 is a sectional view of the invention.

Referring to FIG. 3, each of the actuating portions 30 has a moving portion 300 located in the displacement portion 12 and a restricting portion 302 located at a front end of the moving portion 300 greater than the aperture of the displacement portion 12. During assembly the restricting portion 302 is latched on the aperture of the displacement 12 through a chamfered surface so that the actuating portion 30 can be restricted in the aperture of the displacement 12 without escaping and the moving portion 300 can be moved up and down without skewing.

Figure 4A:
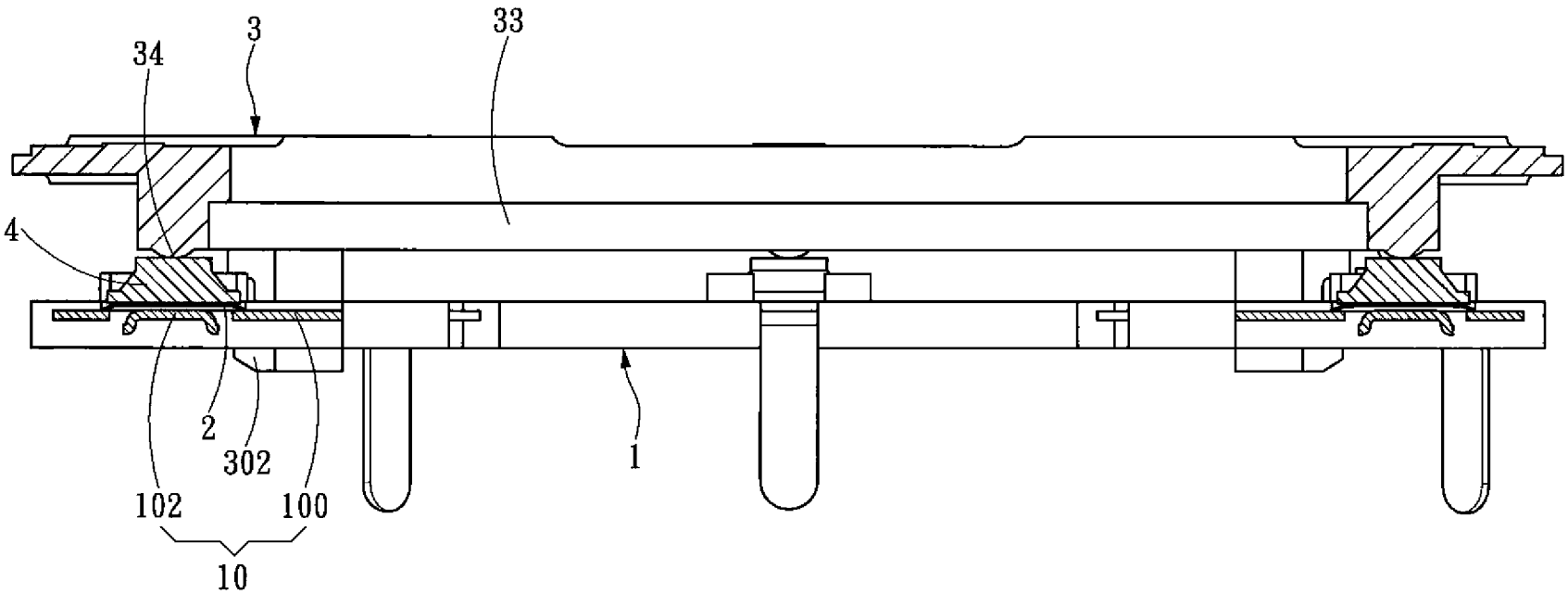
FIG. 4A is a schematic view of the invention in a normal position.

Refer to FIG. 4A for the invention in the normal position. Each contact 34 is in contact with the elastic element 4 in a lightly manner, and held on the common terminal 100 through the elastic contact element 2. In such a condition the elastic contact element 2 is always in contact with the common terminal 100 and in this condition without connecting the signal terminal 102.

Figure 4B:
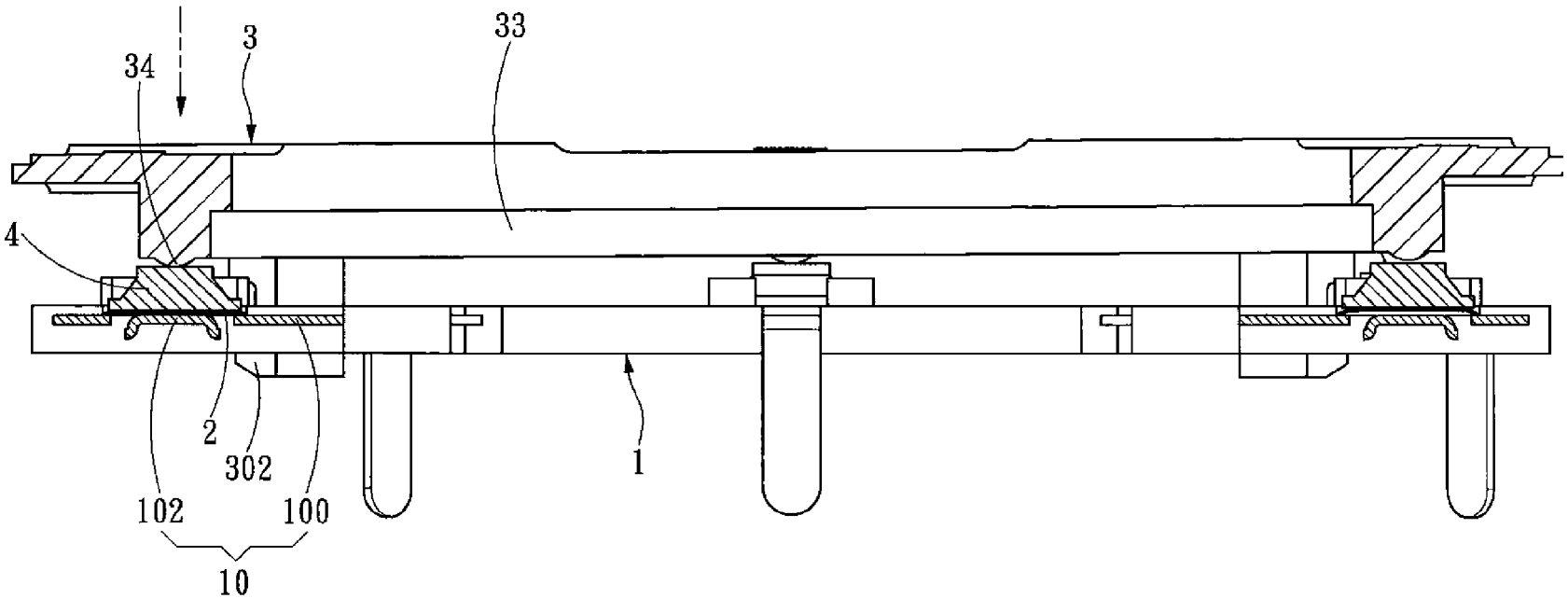
FIG. 4B is a schematic view of the invention in an instruction generating position.
Figure 4C:
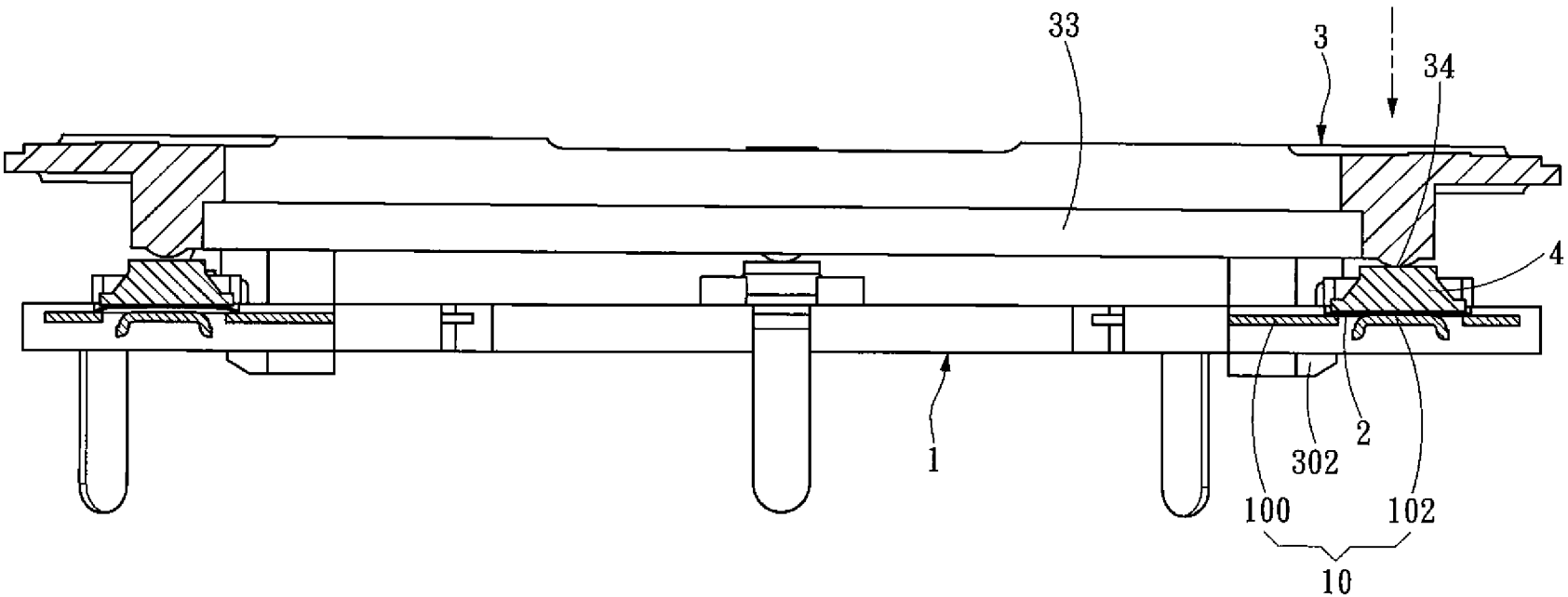
FIG. 4C is another schematic view of the invention in the instruction generating position.

Refer to FIGS. 4B and 4C for the invention in the instruction generating position. When the surface of the annular click member 3 receives a force, it is moved to the instruction generating position, and the contact 34 presses the elastic elements 4, consequently the elastic contact element 2 is moved downwards to press the common terminal 100 and the signal terminal 102. With the elastic contact element 2 connecting to the common terminal 100 and signal terminal 102 at the same time, an instruction signal is generated and output. Meanwhile, the elastic contact element 2 and the elastic element 4 store the return force at the same time. When any one direction of the inner four ways of the annular click member 3 is depressed through the key, through the supporting aid of the elastic element 4 and the restriction of the detent wall 16, the keys in the neighboring directions do not form conductive contact or erroneous signal output due to surface inclining of the annular click member 3. Finally, when the force is released from the annular click member 3 the elastic contact element 2 and the elastic member 4 bounce back to their normal positions because of the return force. Thereby the annular click member 3 returns to an original balanced condition from the depressed and inclined condition.

Figure 5:
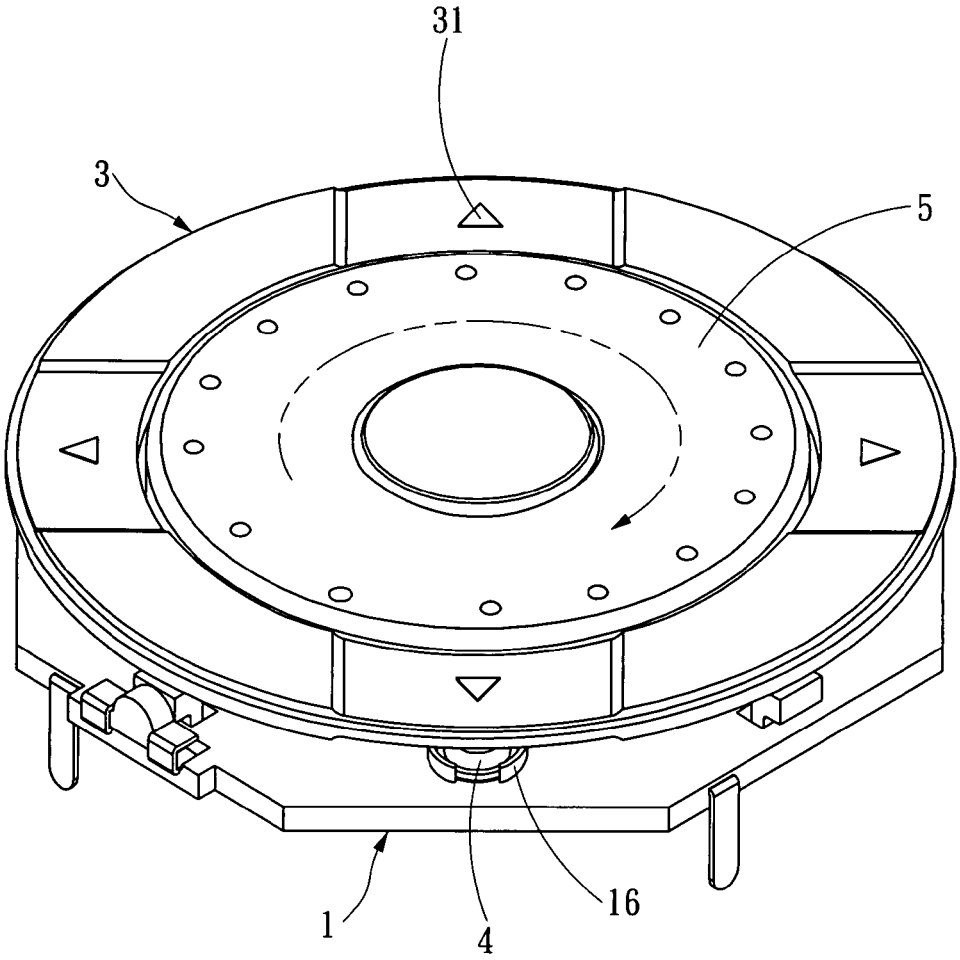
FIG. 5 is a schematic view of the invention coupling with a rotary switch.

Thus, by forming the housing space 33 with another installation opening 14 on the circuit board 1 with the same shape as the installation opening 32, a rotary switch 5 can be held in the housing space 33 (referring to FIG. 5). Therefore users can perform multi-direction operation on the annular click member 3 and rotary operation on the rotary switch 5 to suit their requirements.

As a conclusion, by means of the invention users not only can execute multiple instructions through the rotary switch 5 held in the housing space 33, the annular multi-instruction switch also provides four-way or eight-ways operation. Hence flexible and versatile operations and controls can be provided. It offers a significant improvement over the conventional techniques.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An annular multi-instruction switch, comprising:

a circuit board which is wired to connect at least one common terminal and a plurality of signal terminals to form multiple instruction switches, each of the instruction switches has an elastic contact element built with a return force, the circuit board also having a plurality of displacement portions, wherein the elastic contact element is always connected with the common terminal; and an annular click member which has actuating portions with moving portions reciprocally moving up and down through the displacement portions such that the annular click member performs a vertical displacement relative to the circuit board to make the annular click member situated at a normal position and an instruction generating position, an installation opening in the center in cooperation with the circuit board to form a housing space, and contacts corresponding to the elastic contact elements such that when the annular click member receives a force and is moved to the instruction generating position the contact directly connects and presses the elastic contact element and the return force is stored and the common terminal and one signal terminal are connected to generate and output an instruction signal; when the force is released from the annular click member the elastic contact element bounces back due to the return force to the normal position.

2. The annular multi-instruction switch of claim 1, wherein the circuit board has another installation opening corresponding to the installation opening formed in the annular click member.

3. The annular multi-instruction switch of claim 1, wherein the housing space holds a rotary switch.

4. The annular multi-instruction switch of claim 1, wherein the contacts are formed integrally on the annular click member in a bulged fashion.

5. The annular multi-instruction switch of claim 1, wherein the elastic contact elements and the annular click member are interposed by elastic elements to aid support and the return force.

6. The annular multi-instruction switch of claim 1, wherein the annular click member has instruction marks on the surface where the instruction switches are located.

7. The annular multi-instruction switch of claim 1, wherein the displacement portions are apertures, each actuating portion including a moving portion located on each displacement portion and a restricting portion located at a front end of the moving portion and formed of a size greater than the aperture of the displacement portion.

8. An annular multi-instruction switch, comprising:

a circuit board which is wired to connect at least one common terminal and a plurality of signal terminals to form multiple instruction switches, each of the instruction switches has an elastic contact element built with a return force, the circuit board also having a plurality of displacement portions, wherein the elastic contact element is always connected with the common terminal; and an annular click member which has actuating portions corresponding to and coupling with the displacement portions such that the annular click member performs a vertical displacement relative to the circuit board to form a normal position and an instruction generating position, an installation opening in the center in cooperation with the circuit board to form a housing space, and contacts corresponding to the elastic contact elements such that when the annular click member receives a force and is moved to the instruction generating position the contact directly connects and presses the elastic contact element and the return force is stored and the common terminal and one signal terminal are connected to generate and output an instruction signal; when the force is released from the annular click member the elastic contact element bounces back due to the return force to the normal position;

wherein the circuit board has jutting detent walls surrounding the elastic contact elements to prevent erroneous conductive contact.

* * * * *